US011226583B2

(12) United States Patent
Lee et al.

(10) Patent No.: US 11,226,583 B2
(45) Date of Patent: Jan. 18, 2022

(54) COUPLER HOLDER BASED TONER LOCKING SYSTEM

(71) Applicant: Hewlett-Packard Development Company, L.P., Spring, TX (US)

(72) Inventors: Hanjun Lee, Seongnam-si (KR); Younghoon Kim, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/252,369

(22) PCT Filed: Sep. 4, 2019

(86) PCT No.: PCT/US2019/049433
§ 371 (c)(1),
(2) Date: Dec. 15, 2020

(87) PCT Pub. No.: WO2020/096683
PCT Pub. Date: May 14, 2020

(65) Prior Publication Data

US 2021/0263462 A1 Aug. 26, 2021

(51) Int. Cl.
*G03G 21/16* (2006.01)
*G03G 15/08* (2006.01)

(52) U.S. Cl.
CPC ..... *G03G 21/1647* (2013.01); *G03G 15/0875* (2013.01); *G03G 21/1676* (2013.01)

(58) Field of Classification Search
CPC ..... G03G 15/0875; G03G 21/1647; G03G 21/1676; G03G 2221/1657
See application file for complete search history.

(56) References Cited

U.S. PATENT DOCUMENTS

| | | | | |
|---|---|---|---|---|
| 8,229,320 | B2 | 7/2012 | Kimizuka et al. | |
| 2009/0016779 | A1 | 1/2009 | Hwang | |
| 2009/0179976 | A1 | 7/2009 | Nakazawa et al. | |
| 2009/0303300 | A1 | 12/2009 | Silverbrook et al. | |
| 2011/0150527 | A1 | 6/2011 | Kishi et al. | |
| 2012/0087699 | A1 | 4/2012 | Wu et al. | |
| 2016/0370757 | A1* | 12/2016 | Sato | G03G 21/1647 |
| 2018/0074454 | A1* | 3/2018 | Uneme | G03G 21/186 |

FOREIGN PATENT DOCUMENTS

JP 2011-64846 A 3/2011

* cited by examiner

*Primary Examiner* — Sophia S Chen
(74) *Attorney, Agent, or Firm* — Jefferson IP Law, LLP

(57) ABSTRACT

An image forming apparatus is provided. The image forming apparatus includes a main body frame, a developer cartridge detachably mounted on the main body frame, a driving gear deployed on one side of the main body frame to rotate in a first direction to drive the developer cartridge, and a locking member deployed between the driving gear and the developer cartridge to fix the developer cartridge in a locking position in which the developer cartridge is mounted on the main body frame, wherein the locking member is to move the developer cartridge to an unlocking position in which the developer cartridge is separated from the main body frame by a rotation of the driving gear in a second direction opposite to the first direction.

15 Claims, 9 Drawing Sheets

COUPLER HOLDER BASED TONER LOCKING SYSTEM

BACKGROUND OF THE INVENTION

An image forming apparatus is an apparatus that forms an image on a recording medium in accordance with an input signal, and may include a printer, a copier, a scanner, a fax machine, or a multifunction printer integrally implementing the functions of the printer, the copier, the scanner, and the fax machine.

As a kind of image forming apparatus, an electrophotographic image forming apparatus is provided with a developer cartridge, including a photosensitive drum having a developer roller therein, and an exposure unit. The exposure unit forms an electrostatic latent image on a surface of the photosensitive drum by scanning light onto the photosensitive drum that is charged with a specific electric potential, and a developer unit forms a visible image on the surface of the photosensitive drum by supplying a developing agent onto the photosensitive drum on which the electrostatic latent image is formed.

The developer cartridge is an assembly of components for forming the visible image and may be mounted on a tray to be drawn out of a main body of the image forming apparatus. When the developing agent contained in the developer cartridge has expired, the developer cartridge may be refilled or replaced.

BRIEF DESCRIPTION OF THE DRAWING FIGURES

Certain examples of the present disclosure will be more apparent from the following description taken in conjunction with the accompanying drawings, in which.

Throughout the drawings, it should be noted that like reference numbers are used to depict the same or similar elements, features, parts, components, and structures.

DETAILED DESCRIPTION

Figure 1:
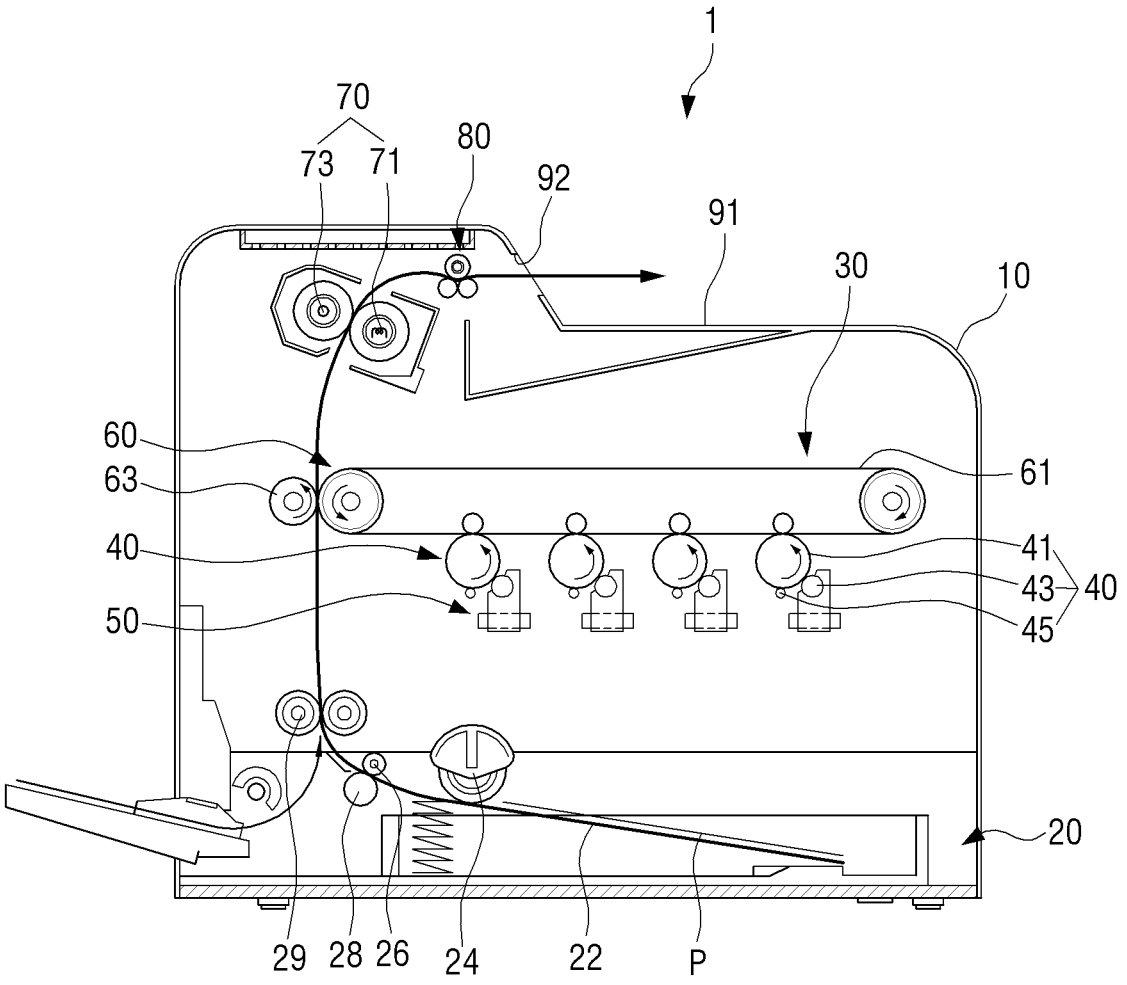
FIG. 1 is a schematic cross-sectional view of an image forming apparatus according to an example.

Hereinafter, various examples will be described with reference to the accompanying drawings. Various changes and modifications of the examples described hereinafter may be implemented. In order to explain the features of the examples more accurately, a detailed explanation of matters well-known to those of ordinary skill in the art to which the following examples of the present disclosure pertain will be omitted.

In the description, if it is described that a certain element is connected to another element, it means not only a direct connection between the elements but also an indirect connection through another element. Further, if it is described that a certain element includes another element, it means that the certain element does not exclude other elements, but may further include the other elements unless specially described to the contrary.

Further, an "image forming apparatus" is an apparatus for printing print data generated from a terminal device such as a computer on a recording paper. Examples of such an image forming apparatus include a printer, a copier, a scanner, a fax machine, and a multifunction printer (MFP) in which the functions of the printer, the copier, the scanner, and the fax machine are compositely implemented through one device. The image forming apparatus may mean any device capable of performing an image forming job, such as the printer, the copier, the scanner, the fax machine, the multifunction printer (MFP), or a display device.

The examples to be described hereinafter are provided to help understand the technical features of the present disclosure, and it should be understood that various changes and modifications can be made in a manner different from that of the examples described hereinafter. However, in the following description, related well-known functions or constituent elements are not described and illustrated in detail for sake of brevity. Further, in order to help understand the present disclosure, sizes of some constituent elements illustrated in the drawings may be exaggerated for clarity in explanation.

Hereinafter, an image forming apparatus according to an example of the present disclosure will be briefly described, and then a locking structure of a developer cartridge will be described in more detail.

FIG. 1 is a schematic cross-sectional view of an image forming apparatus according to an example.

Referring to FIG. 1, an image forming apparatus 1 may include a main body 10, a paper feed unit 20, a print engine 30, and a paper discharge unit 80.

A paper discharge tray 91 for receiving papers on which images have been formed is provided on an upper portion of the main body 10, and a paper discharge port 92 for to discharge the image-formed papers is provided on one side of the paper discharge tray 91.

The paper feed unit 20 is detachably and movably installed on the main body 10 and includes a knock-up plate 22 deployed in the paper feed unit 20 to load paper P thereon.

The paper feed unit 20 may include a pickup roller 24 deployed on one side of an upper portion of the paper feed unit 20 to pick up the papers loaded on the knock-up plate 22 one by one, a forward roller 26 to transfer the papers picked up by the pickup roller 24 toward a pair of feed rollers 29, a retard roller 28 deployed opposite to the forward roller 26 to prevent simultaneous movements of a plurality of papers, and the pair of the feed rollers 29 deployed on an upper side of the pickup roller 24 to guide the papers picked up by the pickup roller 24 to the print engine 30.

The print engine 30 forms an image on the paper P supplied from the paper feed unit 20. The print engine 30 can electrophotographically form the image on the paper P.

The print engine 30 may be provided with a developer unit 40, a developer cartridge 50, a transfer unit 60, and a fuser unit 70.

The developer unit 40 forms an image on a supplied paper P, and the fuser unit 70 fuses a visible image onto the paper. The developer unit 40 includes a photosensitive drum 41 composed of an image carrier accommodating the visible image by a developing agent and having a surface on which an electrostatic latent image is formed by an exposure unit, a developer roller 43 to develop the electrostatic latent image of the photosensitive drum 41 as the visible image by the developing agent by supplying the developing agent onto the photosensitive drum 41, and a charging roller 45 to charge the surface of the photosensitive drum 41.

A plurality of developer units 40 and a plurality of developer cartridges 50 may be provided. The plurality of developer cartridges 50 are respectively connected to the plurality of developer units 40, and the developing agents accommodated in the plurality of developer cartridges 50 are respectively supplied to the plurality of developer units 40.

The plurality of developer cartridges 50 and the plurality of developer units 40 may be individually replaced. The plurality of developer cartridges 50 and the plurality of developer units 40 may be individually mounted on or separated from the main body 10. For example, a front surface of the main body 10 may be opened by opening a door (not illustrated) located on the main body 10, and the plurality of developer cartridges 50 may be mounted on or separated from the main body 10.

If the developing agent accommodated in one or more of the plurality of developer cartridges 50 has been exhausted, the one or more corresponding developer cartridge 50 may be separated from the main body 10, and one or more new developer cartridge 50 may be mounted on the main body 10, respectively.

In this case, the image forming apparatus 1 may include a locking member that fixes the developer cartridge 50 in a state where the developer cartridge 50 is mounted on the main body 10. The locking member may perform a forward rotation to mount the developer cartridge 50 on the main body 10 and perform a reverse rotation to separate the developer cartridge 50 from the main body 10. Examples of a structure and operation processes of the locking member will be described later.

In an example operation, a plurality of photosensitive drums 41 form electrostatic latent images, the developer cartridges 50 form visible images through attachment of the developing agents onto the respective photosensitive drums 41, and the transfer unit 60 transfers the visible images onto the paper.

The plurality of developer cartridges 50 may include a plurality of developing agent accommodation units in which developing agents of cyan (C), magenta (M), yellow (Y), and black (K) to be supplied to the plurality of developer units 40 are respectively accommodated. However, this is only an example and additional developer cartridges 50 and developer units 40 may be further provided to accommodate and develop developing agents of various colors, such as light magenta, white, and so on, in addition to the above-described colors. Hereafter, the developer cartridge can be also referred to as "the cartridge" or "the toner cartridge."

Each of the plurality of developer cartridges 50 may include an agitator member (not illustrated) that agitates the developing agent accommodated in the developing agent accommodation unit and supplies the agitated developing agent to the developer unit 40.

The locking member for fixing the developer cartridge 50 may be connected to a driving gear that drives the agitator member, and can lock the developer cartridge 50 in the image forming apparatus 1 or unlock the developer cartridge 50 from the image forming apparatus 1 without any additional power device.

The plurality of developer cartridges 50 store developing agents of different colors (e.g., yellow, magenta, cyan, and black) therein, and make visible images of different colors through attachment of the developing agents onto the photosensitive drums 41 on which the electrostatic latent images are formed.

Further, the transfer unit 60 includes a middle transfer belt 61 to make a visible color image by making the visible images formed on the respective photosensitive drums 41 overlap one another, and a last transfer roller 63 to transfer the visible color image formed on the middle transfer belt 61 onto the paper. On the middle transfer belt 61, the visible images formed on the respective photosensitive drums 41 are successively transferred to overlap one another, and the visible images formed on the respective photosensitive drums 41 are transferred to the middle transfer belt 61.

The visible images transferred onto the paper P are heated and pressed when passing through the fuser unit 70 and are fused on the surface of the paper. The fuser unit 70 includes a heating roller 71 to generate heat, and a pressing roller 73 having an outer periphery including an elastically deformable material and to press the paper on an outer periphery of the heating roller 71.

The paper P having passed through the fusing unit 70 is discharged to an outside of the main body 10 of the image forming apparatus by the paper discharge unit 80.

Although an example of the image forming apparatus has been described, the development type is not limited thereto. Rather, various modifications and changes of the configuration of the image forming apparatus in accordance with the development type are possible.

Figure 2:
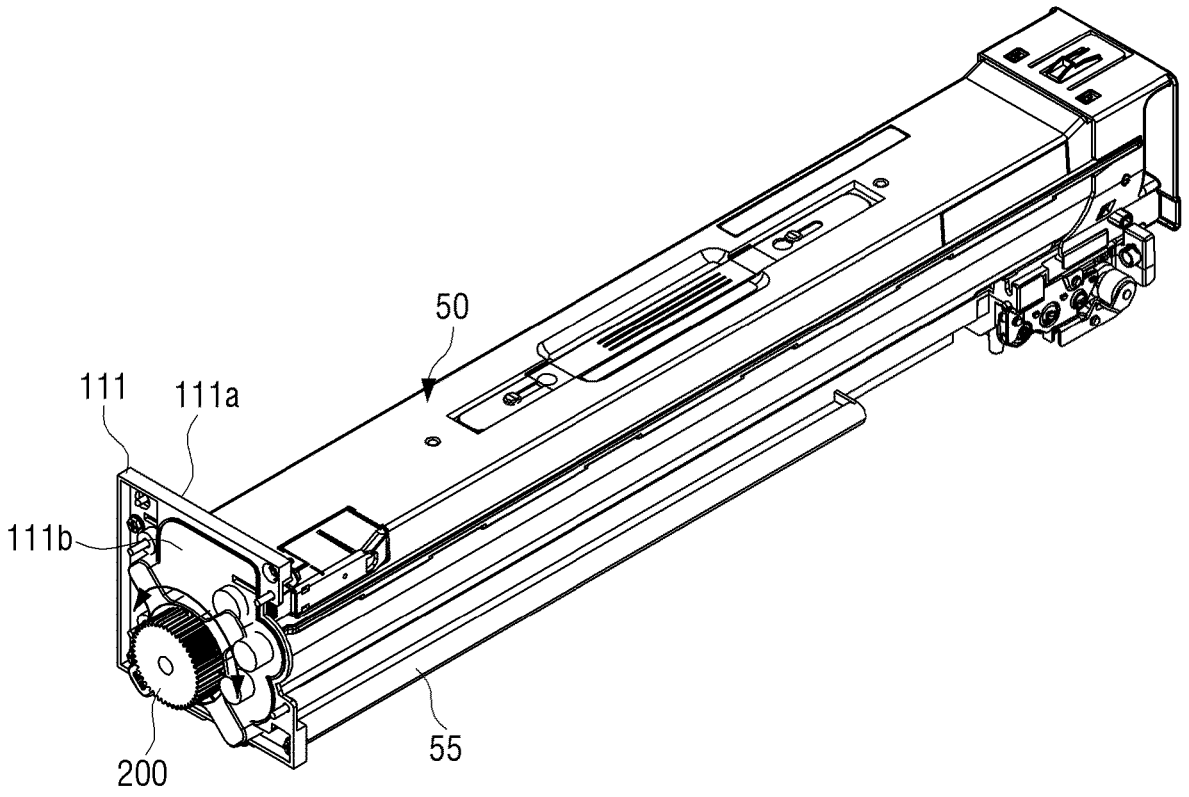
FIG. 2 is a perspective view of a developer cartridge illustrated in FIG. 1 according to an example.

FIG. 2 is a perspective view of a developer cartridge illustrated in FIG. 1 according to an example.

Referring to FIG. 2, an image forming apparatus 1 may include a main body frame 111, a developer cartridge 50 detachably mounted on the main body frame 111, a driving gear 200 to drive the developer cartridge 50, and a locking member to fix the developer cartridge 50 in a state where the developer cartridge 50 is mounted on the main body frame 111.

The main body frame 111 may correspond to a portion of a main body of an image forming apparatus (e.g., the main body 10 of the image forming apparatus 1) on which the developer cartridge 50 is directly mounted and may configure a part of the main body 10. The developer cartridge 50 may be partially inserted and deployed in the main body frame 111 to be mounted on the image forming apparatus 1. Although it has been described that the developer cartridge 50 is detachably mounted on the main body frame 111, this is merely an example and the developer cartridge 50 is not limited thereto. Rather, the developer cartridge 50 may be detachably mounted on the main body 10.

The main body frame 111 may include a front surface 111*a* on which the developer cartridge 50 is vertically mounted with respect to the main body frame 111, and a rear surface 111*b* on which the driving gear 200 capable of driving the developer cartridge 50 is deployed.

An accommodation groove for mounting the developer cartridge 50 may be located between the front surface 111*a* and the rear surface 111*b* of the main body frame 111. The accommodation groove is a constituent element of the locking member to be described later and may fix the developer cartridge 50 in a locking position corresponding to a state where the developer cartridge 50 is mounted on the main body frame 111.

A guide rail 55 may be located at a lower end of the main body frame 111. The developer cartridge 50 may be mounted so that it is accommodated in the accommodation groove of the main body frame 111 along the guide rail 55. The guide rail 55 may guide mounting and separation directions of the developer cartridge 50.

The driving gear 200 may drive an agitator member that is a rotary member of the developer cartridge 50 by a driving motor (not illustrated) provided in the main body 10 in a case where the developer cartridge 50 is mounted on the main body 10.

The driving gear 200 is rotatable by the driving motor and may perform bidirectional rotation. By rotation of the driving gear 200 in a first direction, the agitator member may be driven to be rotated. On the other hand, by rotation of the driving gear 200 in a second direction that is opposite to the first direction, the developer cartridge 50 may be separated from the main body frame 111. An example operation of the developer cartridge 50 in accordance with driving of the driving gear 200 will be described later.

The developer cartridge 50 may include a developing agent accommodation unit to accommodate the developing agent, and an agitator member rotatably located in the developing agent accommodation unit.

The agitator member may agitate the developing agent accommodated in the developing agent accommodation unit and may provide the developing agent to a developer unit (e.g., developer unit 40). A rotary shaft of the developer cartridge 50 (e.g., a rotary shaft of an agitator unit) may be connected to a power transfer coupler and may receive a driving force transferred from the driving gear 200. The agitator member that is rotated by the driving gear 200 may agitate the developing agent in the developer cartridge 50 to assist in smoothly supplying the developing agent from the developer cartridge 50 to the developer unit 40.

The developer cartridge 50 may be connected to the driving gear 200 by the locking member. The locking member may be deployed between the driving gear 200 and the developer cartridge 50.

When the developer cartridge 50 is coupled to the main body frame 111, the locking member may be rotated in the first direction to fix the developer cartridge 50 in a state where the developer cartridge 50 is coupled to the main body frame 111. When the developer cartridge 50 is separated from the main body frame 111, the locking member may be rotated in the second direction to separate the developer cartridge 50 and the main body frame 111 from each other.

An example configuration of a locking member will be described hereinafter.

Figure 3:
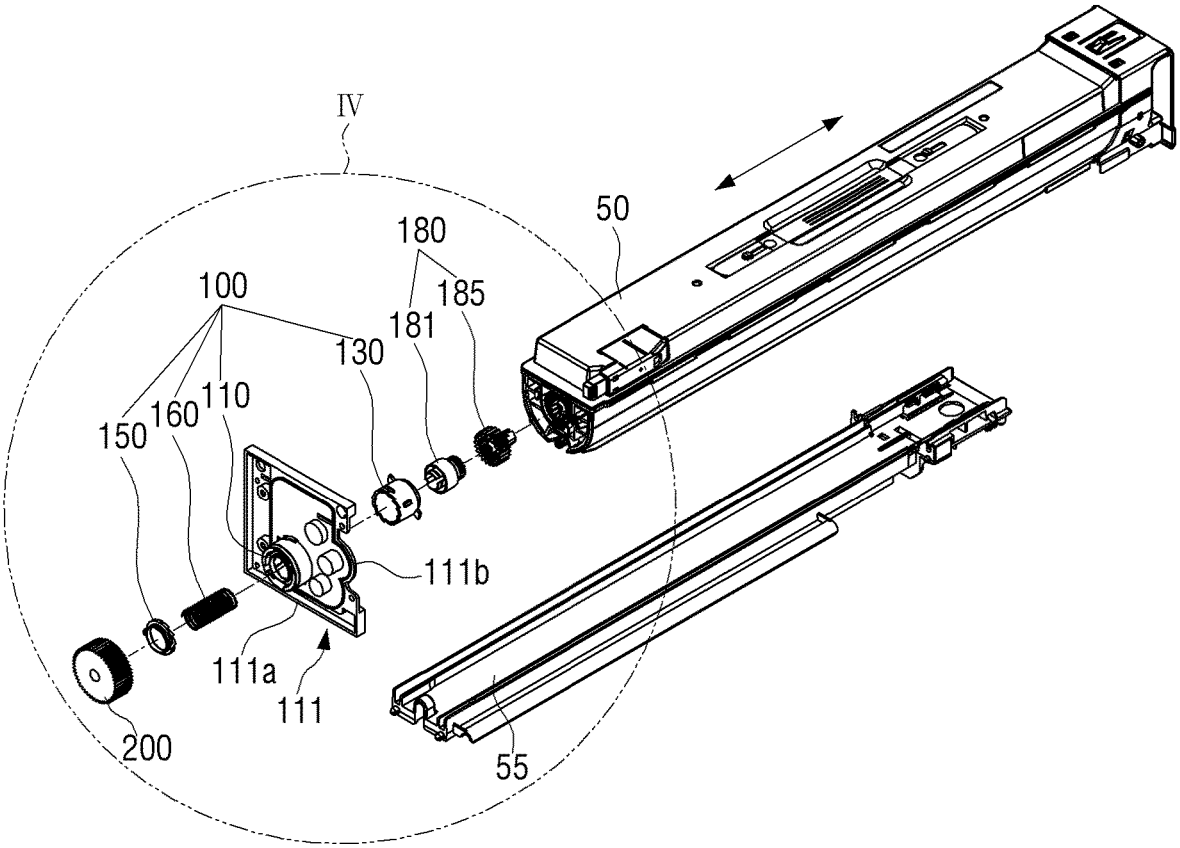
FIG. 3 is an exploded perspective view of FIG. 2 according to an example.
Figure 4:
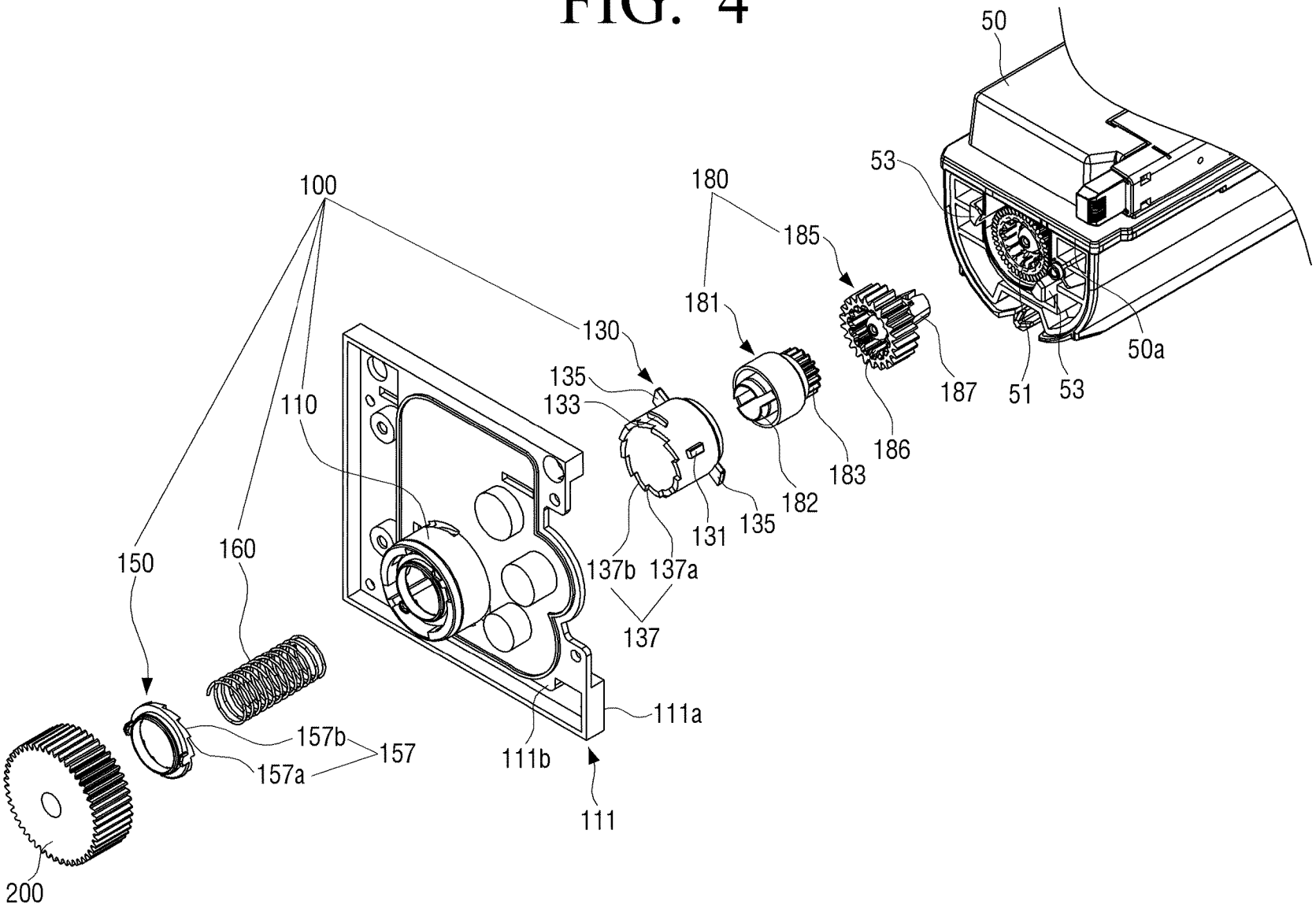
FIG. 4 is an enlarged view of portion IV indicated in FIG. 3 according to an example.

FIG. 3 is an exploded perspective view of FIG. 2 according to an example. FIG. 4 is an enlarged view of portion IV indicated in FIG. 3 according to an example.

Referring to FIGS. 3 and 4, a locking member 100 and a power transfer member 180 may be deployed between a driving gear 200 and a developer cartridge 50.

The developer cartridge 50 may be mounted on or separated from a main body frame 111 in a direction along a guide rail 55. The developer cartridge 50 mounted on the main body frame 111 may be fixed in a locked position by the locking member 100. Further, the locking member 100 may move the developer cartridge 50 to an unlocking position in which the developer cartridge 50 may be separated from the main body frame 111.

The locking member 100 may fix the developer cartridge 50 in the locked position in which the developer cartridge 50 is mounted on the main body frame 111. One end of the locking member 100 may be connected to the driving gear 200, and the other end thereof may be coupled to or separated from the developer cartridge 50.

In an example, the locking member 100 may include an accommodation groove 110 located on the main body frame 111, a coupler holder 130 deployed in the accommodation groove 110 and coupled to a rotary shaft 51 of the developer cartridge 50, a clutch 150 to partially block a rotating force of the driving gear 200, and an elastic member 160 to press the coupler holder 130 in a direction in which the coupler holder 130 is separated from the clutch 150.

The accommodation groove 110 may be located on the main body frame 111. The accommodation groove 110 may have a space capable of accommodating the coupler holder 130 therein so that the coupler holder 130 can move (e.g., forward and backward) inside the accommodation groove 110.

The accommodation groove 110 may further include a guide groove to guide movement (e.g., forward and backward movement) of the coupler holder 130 to be described later. The guide groove may be located on an inner surface of the accommodation groove 110. The guide groove may guide the movement of a guide projection 131 of the coupler holder 130 to be described later so as to rotate the coupler holder 130 and to move the coupler holder 130 in the accommodation groove 110.

The accommodation groove 110 may further include a support groove to support a support projection of the coupler holder 130 so that the coupler holder 130 does not secede from the accommodation groove 110.

Examples of shapes of a support groove and a guide groove will be described later with reference to FIG. 5.

The coupler holder 130 may be deployed to be movable (e.g., forward or backward) in the accommodation groove 110. The coupler holder 130 may have a hollow cylindrical shape including a space in which a power transfer female coupler 181 of the power transfer member 180 can be deployed. A coupling shaft 182 of the power transfer female coupler 181 deployed inside the coupler holder 130 may be coupled to the driving gear 200.

The coupler holder 130 may include a guide projection 131 to guide the rotation and movement of the coupler holder 130, a support projection 133 to support the coupler holder 130 so that the coupler holder 130 does not secede from the accommodation groove 110, and a fixing projection 135 capable of being selectively coupled to the developer cartridge 50.

The guide projection 131, the support projection 133, and the fixing projection 135 may be located on an outer periphery of the coupler holder 130.

The guide projection 131 may project from the center of the coupler holder 130 and may be located along a length direction of the coupler holder 130. The guide projection 131 may be inserted into the guide groove 113. Accordingly, the guide projection 131 may rotatably move along the guide groove 113. As the guide projection 131 rotatably moves in the first direction, the coupler holder 130 can move forward in a direction of the driving gear 200. As the guide projection 131 rotatably moves in the second direction, the coupler holder 130 may move backward in an opposite direction to the direction of the driving gear 200.

The support projection 133 may be adjacent to one end of the coupler holder 130 and may project from the outer periphery of the coupler holder 130. The support projection 133 can be rotated along the support groove located on the accommodation groove 110 and can be supported in the support groove to prevent the coupler holder 130 from seceding from the accommodation groove 110.

By the support projection 133, the coupler holder 130 may be driven forward or backward in the accommodation groove 110.

The fixing projection 135 may be located at the other end of the coupler holder 130 and may be deployed adjacent to the developer cartridge 50.

The fixing projection 135 may be selectively coupled to the developer cartridge 50. As an example, as the fixing projection 135 rotatably moves in the first direction, it may be fixedly inserted into a fixing groove 53 located on one side 50*a* of the developer cartridge 50. As the fixing projection 135 is coupled to the developer cartridge 50, the developer cartridge 50 may move forward together with the coupler holder 130.

As the fixing projection 135 rotatably moves in the second direction, coupling to the developer cartridge 50 may be unlocked. As the fixing projection 135 and the developer cartridge 50 are separated from each other, the developer cartridge 50 may be separated from the main body frame 111 and may move independently of the coupling holder 130.

The fixing groove 53 may project from one side 50*a* of the developer cartridge 50 coupled to the main body frame 111. The fixing groove 53 may have one side thereof opened. The fixing projection 135 may be inserted into or separated from the opened one side of the fixing groove 53 through its rotation.

On one side of the coupler holder 130, a second clutch part 137 capable of being coupled to the clutch 150 to be described later may be located.

The clutch 150 may be a one-way clutch to selectively connect the developer cartridge 50 and the driving gear 200 to each other. As an example, the clutch 150 may be provided on the driving gear 200. The clutch 150 may include a first clutch part 157 provided on one side of the coupler holder 130 and the second clutch part 137 capable of being coupled to the first clutch part 157. The first clutch part 157 is configured so that a first locking part 157*a* and a first inclination part 157*b* are repeatedly arranged in the circumferential direction, and the second clutch part 137 is configured so that a second locking part 137*a* and a second inclination part 137*b*, which face the first locking part 157*a* and the first inclination part 157*b*, respectively, are repeatedly arranged in the circumferential direction.

The elastic member 160 may be deployed between the clutch 150 on which the first clutch part 157 is located and the coupler holder 130 on which the second clutch part 137 is located. The elastic member 160 may provide an elastic force in a direction in which the coupler holder 130 is separated from the clutch 150 by pressing the coupler holder 130 in an opposite direction to the driving gear 200.

The image forming apparatus may include the power transfer member 180 to transfer the driving force of the driving gear 200 to the developer cartridge 50.

The power transfer member 180 may include the power transfer female coupler 181 connected to the driving gear 200 and a power transfer coupler 185 connected to one side 50*a* of the developer cartridge 50.

The power transfer female coupler 181 may be connected to the driving gear 200 and may be rotated in the first or second direction together with the driving gear 200. The power transfer female coupler 181 may be coupled to the power transfer coupler 185 and may transfer the rotating force of the driving gear 200 to the power transfer coupler 185.

The power transfer female coupler 181 may include the coupling shaft 182 coupled to the driving gear 200 and a female connection gear 183 coupled to the power transfer coupler 185 located on the developer cartridge 50. The female connection gear 183 of the power transfer female coupler 181 may have a shape corresponding to a connection gear 186 of the power transfer coupler 185.

The power transfer coupler 185 may be located on one side 50*a* of the developer cartridge 50. The power transfer coupler 185 may be installed on the rotary shaft 51 of the developer cartridge 50. In an example, the power transfer coupler 185 may be coupled to the power transfer female coupler 181 to rotate the agitator member of the developer cartridge 50.

The power transfer coupler 185 may include the connection gear 186 coupled to the power transfer coupler 185 and a coupling shaft 187 connected to the rotary shaft 51 of the developer cartridge 50.

Accordingly, when the developer cartridge 50 is mounted on the main body frame 111, the power transfer female coupler 181 connected to the driving gear 200 may be connected to the power transfer coupler 185 to rotate and drive the agitator member of the developer cartridge 50. The power transfer female coupler 181 may be deployed inside the coupler holder 130. When the developer cartridge 50 is coupled to the main body frame 111, the coupler holder 130 may be coupled to the clutch 150 and may move in the direction of the driving gear, and thus the female connection gear 183 of the power transfer female coupler 181 may be exposed to an outside of the coupler holder 130. The exposed female connection gear 183 and the connection gear 186 of the power transfer coupler 185 may be coupled to each other, and the driving force of the driving gear 200 may be transferred to the developer cartridge 50. Accordingly, if the developer cartridge 50 is coupled to the main body frame 111, the power transfer coupler 185 and the power transfer female coupler 181 may be coupled to each other, and the agitator member may be rotated by the rotation of the driving gear 200.

When the developer cartridge 50 is separated from the main body frame 111, the coupler holder 130 may be decoupled from the clutch 150 and may move backward in an opposite direction to the driving gear by the elastic member 160, and thus the female connection gear 183 of the power transfer female coupler 181 may be inserted into the coupler holder 130. Accordingly, the power transfer female coupler 181 may be decoupled from the power transfer coupler 185 and the rotating force of the driving gear 200 is not transferred to the developer cartridge 50.

Figure 5:
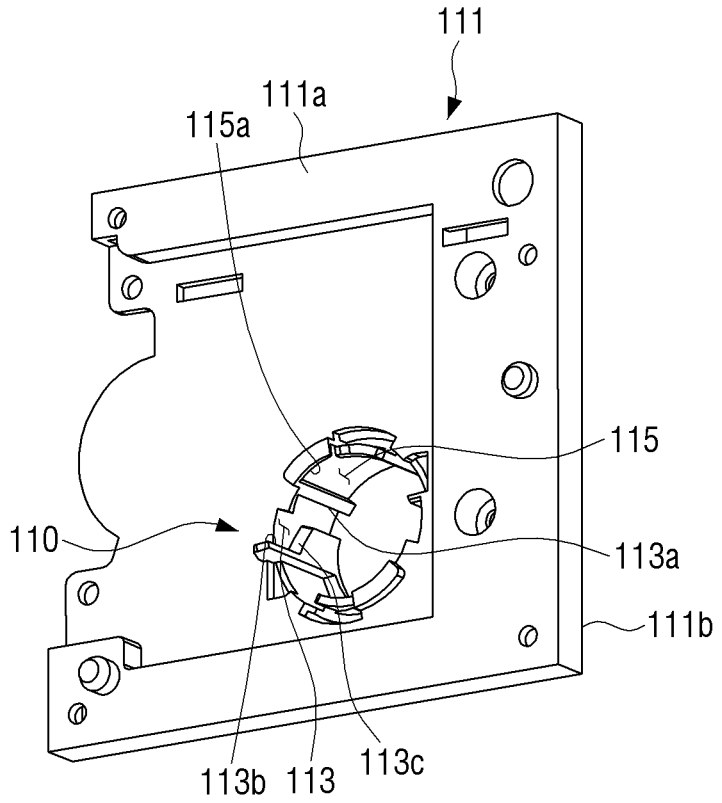
FIG. 5 is a view illustrating a main body frame on which a cartridge is mounted according to an example.

FIG. 5 is a view illustrating a main body frame on which a cartridge is mounted according to an example.

Referring to FIG. 5, an accommodation groove 110, in which a locking member is deployed, may be located on a main body frame 111.

On an inner periphery of the accommodation groove 110, a guide groove 113, in which a guide projection (e.g., guide projection 131) located on a coupler holder (e.g., coupler holder 130) is inserted, may be located.

At least one guide groove 113 may be located along the inner periphery of the accommodation groove 110. The guide groove 113 may include a first opposite surface 113*a*, a second opposite surface 113*b*, and a guide surface 113*c* to connect the first opposite surface 113*a* and the second opposite surface 113*b* to each other.

If the developer cartridge 50 is mounted on the main body frame 111, the guide projection 131 may be rotated in a first direction and may move so as to come in contact with the first opposite surface 113*a*. As an example, the guide projection 131 may be rotated in the first direction in a state where it comes in contact with the second opposite surface 113*b*, and may move along the guide surface 113*c* from the second opposite surface 113*b* so that it comes in contact with the first opposite surface 113*a*. In accordance with the movement of the guide projection 131, the coupler holder 130 may move forward in the direction of the driving gear 200 as being rotated in the first direction. Once the developer cartridge 50 is separated from the main body frame 111, the guide projection 131 may be rotated in the second direction by the rotation of the driving gear 200 in the second direction, and may move to come in contact with the second opposite surface 113*b*. As an example, the guide projection 131 may be rotated in the second direction in a state where it comes in contact with the first opposite surface 113*a*, and may move along the guide surface 113*c* from the first opposite surface 113*a* so that it comes in contact with the second opposite surface 113*b*. In accordance with the movement of the guide projection 131, the coupler holder 130 may move backward in an opposite direction to the direction of the driving gear as being rotated in the second direction.

When the coupler holder 130 moves forward, the guide surface 113*c* may guide the guide projection of the coupler holder 130 to move in the first direction. Accordingly, the first opposite surface 113*a* may be deeper than the second opposite surface 113*b* toward the driving gear 200. That is, the guide surface 113*c* may be inclined upward from the first opposite surface 113*a* to the second opposite surface 113*b*. The guide surface 113*c* may be an inclined surface that connects the first and second stepped opposite surfaces 113*a* and 113*b* to each other.

Further, on the inner periphery of the accommodation groove 110, a support groove 115, in which a support projection (e.g., a support projection 133) located on the outer periphery of the coupler holder 130 is inserted, may be. The support groove 115 may be located on one side of the guide groove 113 adjacent to the guide groove 113. At least one support groove 115 may be provided along the inner periphery of the accommodation groove 110.

The support groove 115 may include a support surface 115*a* located on one side of the support groove 115. The support surface 115*a* may be located on a front surface of the main body frame 111 so that the coupler holder 130 does not secede from the accommodation groove 110 by an elastic force of an elastic member (e.g., the elastic member 160). The support surface 115*a* may project from the one side of the support groove 115 to cover the support groove 115.

The support surface 115*a* may support the support projection 133 so that the support projection 133 does not move in an opposite direction to the direction of the driving gear 200. The support projection 133 may be supported in the support groove 115 by the support surface 115*a*.

One end of the coupler holder 130 is supported by the elastic member 160 to prevent the coupler holder 130 from falling out in the direction of the driving gear 200. Accordingly, it is enough for the support groove 115 to be provided with the support surface 115*a* in an opposite direction to the direction of the driving gear 200.

Figure 6A:
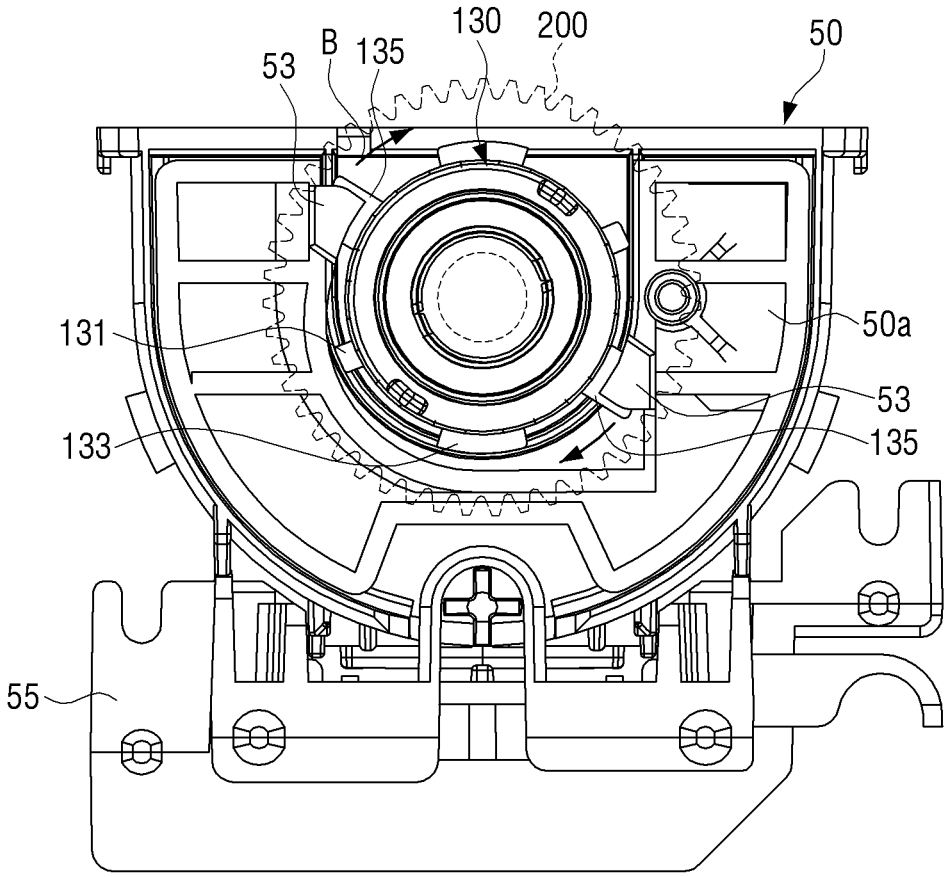
FIG. 6A is a view explaining a locking position of a developer cartridge according to an example.
Figure 6B:
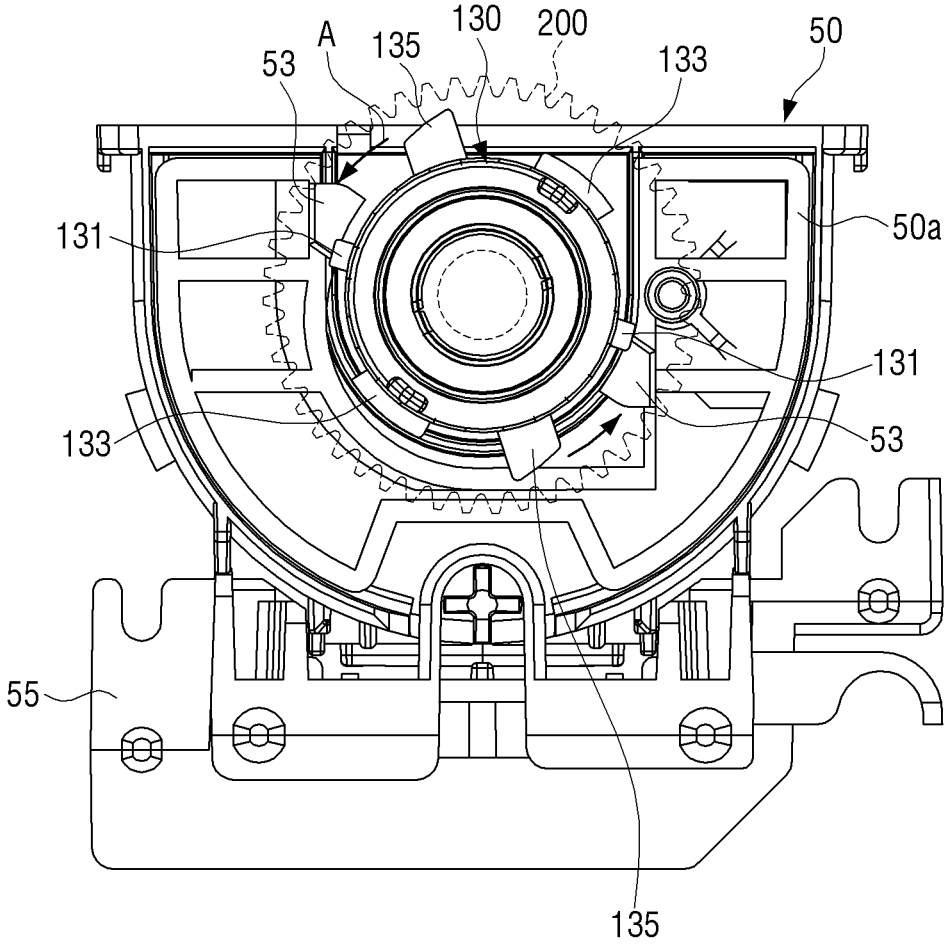
FIG. 6B is a view explaining an unlocking position of a developer cartridge according to an example.

FIG. 6A is a view explaining a locking position of a developer cartridge according to an example. FIG. 6B is a view explaining an unlocking position of a developer cartridge according to an example.

For convenience in explanation, FIGS. 6A and 6B illustrate a locking position and an unlocking position in a state where a main body frame is omitted.

Referring to FIG. 6A, when a developer cartridge 50 is coupled to a main body frame (e.g., main body frame 111), a locking member (e.g., locking member 100) may be coupled to the developer cartridge 50. As an example, a fixing projection 135 of a coupler holder 130 may be coupled to a fixing groove 53 located on one side 50*a* of the developer cartridge 50.

When the developer cartridge 50 is coupled to the main body frame 111, the coupler holder 130 may be pushed in a direction of a driving gear 200 by the developer cartridge 50, and a guide projection 131 of the coupler holder 130 may move forward as being rotated in the first direction A along a guide groove (e.g., guide groove 113) located on an accommodation groove (e.g., accommodation groove 110). By the rotation of the coupler holder 130 in the first direction A, the fixing projection 135 may be rotated in the first direction A (refer to an arrow indicated in FIG. 6B) and may be inserted into the fixing groove 53 located at one end of the developer cartridge 50. As the fixing projection 135 is inserted into the fixing groove 53, the developer cartridge 50 may be coupled to the coupler holder 130 and may move forward together with the coupler holder 130.

The developer cartridge 50 may be coupled to the fixing projection 135 of the coupler holder 130 and may be fixed to the main body frame 111. The developer cartridge 50 fixed to the main body frame 111 by the locking member 100 is unable to be separated from the main body frame 111 by a user's pulling force.

As the developer cartridge 50 is fixed by the locking member 100, a user is unable to control the developer cartridge 50 at the user's discretion, and thus it is possible to prevent damage of the developer cartridge and the developer unit and to prevent theft of the developer cartridge and the developer unit. Accordingly, it is possible to prevent the developer cartridge 50 from being separated from an image forming apparatus (e.g., image forming apparatus 1) by unauthorized users.

In this case, the locking member 100 may fix the developer cartridge 50 in a locking position so that the developer cartridge 50 does not move in a separation direction from the locking position.

Further, because the locking member 100 is unfixed from the locking position by rotating the development cartridge 50 in the second direction, a reliability of a fixing force of the development cartridge 50 is increased, and thus it is possible to prevent unintended separation of the development cartridge 50.

The development cartridge 50 may be separated from the locking member 100 through movement of the coupler holder 130 of the locking member 100 in an arrow direction. The unlocking position in which the development cartridge 50 is separated from the main body frame 111 will be described.

Referring to FIG. 6B, when the development cartridge 50 is separated from the main body frame 111, the fixing projection 135 can be separated from the development cartridge 50.

When the developer cartridge 50 is separated from the main body frame 111, the coupler holder 130 is rotated in the second direction by the driving gear 200 to be disconnected from the clutch 150 and is pushed by the elastic member 160 in an opposite direction to the direction of the driving gear 200.

Accordingly, the fixing projection 135 rotatably moves in the second direction B (refer to an arrow in FIG. 6A) and is decoupled from the developer cartridge 50. Such a structure facilitates replacement of the developer cartridge 50 and thus the maintenance and repair of the developer cartridge 50 can be more easily performed.

Further, such a locking structure can be deployed on the main body frame 111 to which the developer cartridge 50 is coupled, and thus a size of the image forming apparatus 1 can be reduced.

Figure 7A:
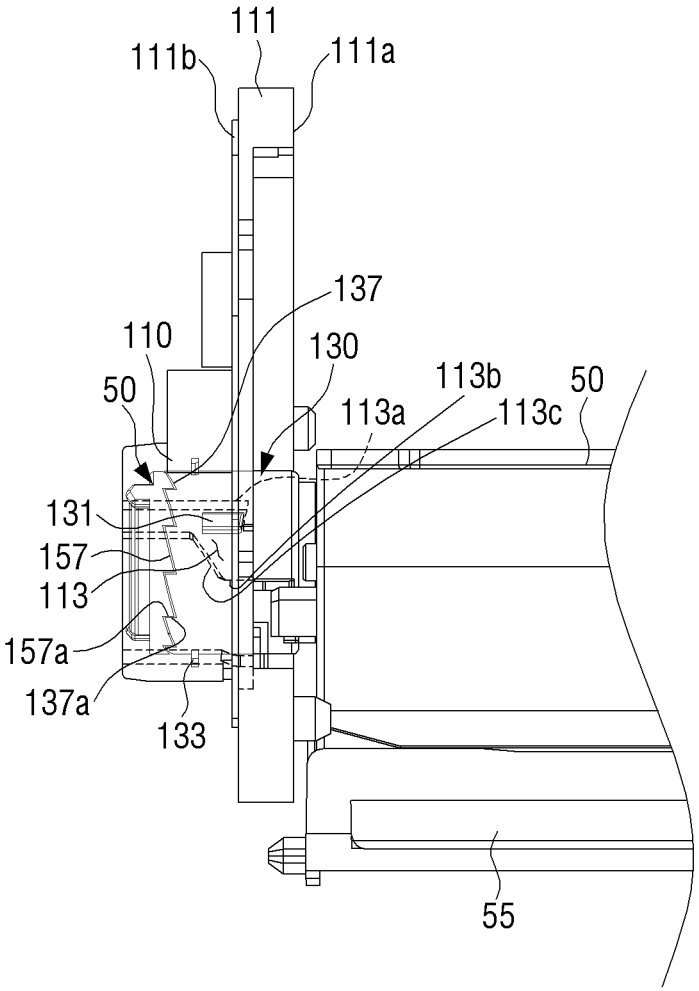
FIG. 7A is a view explaining a locking position in which a developer cartridge is mounted on a main body frame according to an example.
Figure 7B:
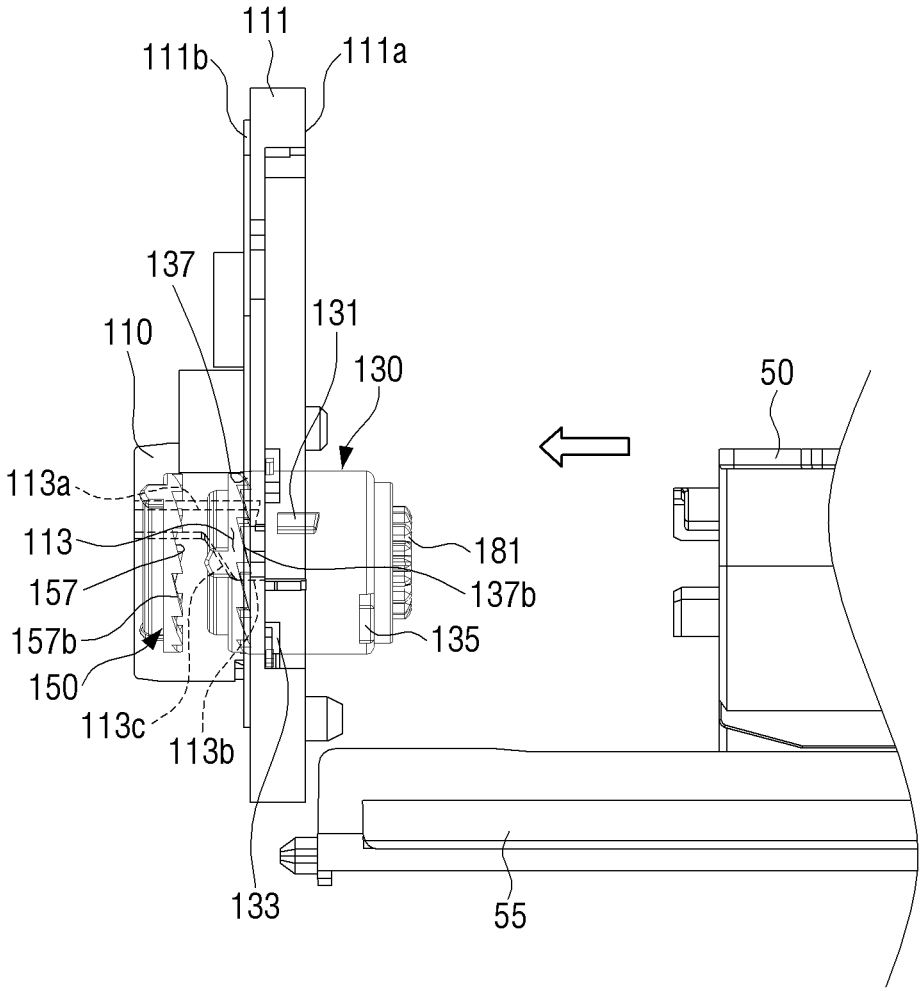
FIG. 7B is a view explaining an unlocking position in which a developer cartridge is separated from a main body frame according to an example.

FIG. 7A is a view explaining a locking position in which a developer cartridge is mounted on a main body frame according to an example. FIG. 7B is a view explaining an unlocking position in which a developer cartridge is separated from a main body frame according to an example.

FIGS. 7A and 7B illustrate a process of driving a locking member 100. The interior of a main body frame 111 is illustrated as dotted lines, and illustration of a driving gear 200 and an elastic member 160 is omitted for convenience.

Referring to FIG. 7A, if a developer cartridge 50 is coupled to the main body frame 111, as illustrated in FIG. 6A, a fixing projection 135 of a coupler holder 130 is inserted into a fixing groove 53 of the developer cartridge 50 to connect the locking member 100 and the developer cartridge 50 to each other. Accordingly, the developer cartridge 50 can move together with the coupler holder 130.

If the developer cartridge 50 is mounted on the main body frame 111, the coupler holder 130 may move forward in the direction of the driving gear 200 by a force for mounting the developer cartridge 50. Accordingly, a guide projection 131 of the coupler holder 130 may move along a guide groove 113 located on an accommodation groove 110. In this case, the coupler holder 130 may be rotated in the first direction and may simultaneously move forward by the guide projection 131 that moves along the guide groove 113.

As an example, the guide projection 131 may move to a first opposite surface 113*a* along a guide surface 113*c* in a position in which the guide projection 131 comes in contact with a second opposite surface 113*b*. By such a rotation of the guide projection 131 in the first direction, the coupler holder 130 can be rotated in the first direction.

As the coupler holder 130 is rotated in the first direction and moves forward at the same time so that the guide projection 131 comes in contact with the first opposite surface 113*a*, a second clutch part 137 located on the coupler holder 130 and a first clutch part 157 of a clutch 150 connected to the driving gear 200 may be engaged with each other.

As an example, a first locking part 157*a* of the first clutch part 157 and a second locking part 137*a* of the second clutch part 137 may be coupled to face each other. Through the coupling of the first clutch part 157 and the second clutch part 137, a power transfer female coupler 181 connected to the driving gear 200 may be connected to a power transfer coupler 185.

Accordingly, if the driving gear 200 is rotated in the first direction A, the power transfer female coupler 181 may also be rotated in the first direction, and the power transfer coupler 185 coupled to the power transfer female coupler 181 may also be rotated in the first direction. By the rotation of the power transfer coupler 185 in the first direction, an agitator member of the developer cartridge 50 connected to the power transfer coupler 185 may also be rotated in the first direction.

The coupler holder 130 may be coupled to the developer cartridge 50 and may move forward in the direction of the driving gear 200 to connect the power transfer female coupler 181 deployed inside the coupler holder 130 to the power transfer coupler 185. Accordingly, the power transfer member 180 may transfer the rotating force of the driving gear 200 to the developer cartridge 50.

Referring to FIG. 7B, when the developer cartridge 50 is separated from the main body frame 111, the developer cartridge 50 may be unlocked by rotating the driving gear 200 in the second direction.

If the driving gear 200 is rotated in the second direction B, a first inclination part 157*b* of the first clutch part 157 and a second inclination part 137*b* of the second clutch part 137 come in contact with each other, and the first clutch part 157 is decoupled from the second clutch part 137 of the coupler holder 130. Accordingly, the coupler holder 130 is pushed in a direction of an elastic force of an elastic member 160.

As the coupler holder 130 is pushed toward an opposite side of the driving gear 200 by the elastic force of the elastic member 160, the guide projection 131 may move from the first opposite surface 113*a* to the second opposite surface 113*b* to push the guide surface 113*c*, and thus the coupler holder 130 may move in an opposite direction to the direction of the driving gear 200. Accordingly, the power transfer female coupler 181 deployed inside the coupler holder 130 may be spaced apart from the power transfer coupler 185. The coupler holder 130 may move backward only up to a section in which the support projection 133 of the coupler holder 130 is supported by the support groove 115.

If the power transfer female coupler 181 is spaced apart from the power transfer coupler 185, the rotating force of the driving gear 200 is not transferred to the developer cartridge 50. As the coupler holder 130 is decoupled from the driving gear 200, the developer cartridge 50 may also be separated from the main body frame 111.

Through the rotation of the driving gear 200 in the second direction B, the development cartridge 50 can move to the unlocking position in which the developer cartridge 50 is separated from the main body frame 111, and thus the developer cartridge 50 can be easily separated.

Although examples of the present disclosure have been illustrated and described as described above, the present disclosure is not limited to the above-described examples, but many alternatives, modifications, and variations will be apparent to those of ordinary skill in the art to which the present disclosure pertains without departing from the gist of the present disclosure. Such alternatives and modifications should not be individually understood from the technical idea or prospect of the present disclosure.

What is claimed is:

1. An image forming apparatus comprising:

a main body frame;

a cartridge detachably mounted on the main body frame;

a driving gear deployed on one side of the main body frame to rotate in a first direction to drive the cartridge; and a locking member deployed between the driving gear and the cartridge to fix the cartridge in a locking position in which the cartridge is mounted on the main body frame, wherein the locking member is to move the cartridge to an unlocking position in which the cartridge is separated from the main body frame by a rotation of the driving gear in a second direction opposite to the first direction.

2. The image forming apparatus as claimed in claim 1, wherein the locking member is coupled to the cartridge by being rotated in the first direction based on a coupling of the cartridge to the main body frame, and wherein the locking member is separated from the cartridge by being rotated in the second direction based on a separation of the cartridge from the main body frame.

3. The image forming apparatus as claimed in claim 1, wherein the locking member comprises:

an accommodation groove located on the main body frame;

a coupler holder deployed in the accommodation groove and coupled to a rotary shaft of the cartridge; and a clutch to transfer a rotating force of the driving gear to the coupler holder based on the rotation of the driving gear in the first direction, and to at least partly block the rotating force of the driving gear transferred to the coupler holder based on the rotation of the driving gear in the second direction.

4. The image forming apparatus as claimed in claim 3, wherein the locking member further comprises an elastic member to provide an elastic force in a direction in which the coupler holder is separated from the clutch.

5. The image forming apparatus as claimed in claim 4, wherein the coupler holder is deployed to be able to move forward and backward in the accommodation groove.

6. The image forming apparatus as claimed in claim 5, wherein the coupler holder is movable between a locking position in which the coupler holder is coupled to the clutch in accordance with a rotating direction of the driving gear and an unlocking position in which the coupler holder is separated from the clutch by the elastic member.

7. The image forming apparatus as claimed in claim 3, wherein the coupler holder includes a guide projection located on an outer periphery of the coupler holder, and wherein the accommodation groove includes a guide groove located on an inner periphery of the accommodation groove to guide a rotation of the guide projection.

8. The image forming apparatus as claimed in claim 7, wherein the guide groove is located so that the guide projection is inserted in the guide groove, and comprises:

a first opposite surface to come in contact with the guide projection based on the rotation of the driving gear in the first direction;

a second opposite surface to come in contact with the guide projection based on the rotation of the driving gear in the second direction; and a guide surface to connect the first opposite surface and the second opposite surface to each other and to guide the guide projection so that the coupler holder moves in the direction of the driving gear based on the rotation of the driving gear in the first direction.

9. The image forming apparatus as claimed in claim 8, wherein the guide surface is inclined downward in the direction of the driving gear.

10. The image forming apparatus as claimed in claim 3, wherein the coupler holder includes a fixing projection located on an outer periphery of the accommodation groove, and wherein the cartridge includes a fixing groove located on an outer surface of the cartridge so that the fixing projection can be inserted into the fixing groove by a rotation of the coupler holder.

11. The image forming apparatus as claimed in claim 10, wherein the fixing projection is to be inserted into the fixing groove to fixedly support the cartridge based on the rotation of the driving gear in the first direction, and is to secede from the fixing groove based on the rotation of the driving gear in the second direction.

12. The image forming apparatus as claimed in claim 3, further comprising a power transfer member to transfer the rotating force of the driving gear to a developing agent conveyance member in the cartridge, wherein the power transfer member further includes:

a power transfer coupler deployed in the coupler holder to be coupled to the driving gear by a rotation of the coupler holder; and a power transfer female coupler located on an outside of the cartridge and connected to a rotary shaft of the developing agent conveyance member.

13. The image forming apparatus as claimed in claim 12, wherein the power transfer coupler is to move forward or backward in a direction of the driving gear in accordance with the rotation of the coupler holder.

14. The image forming apparatus as claimed in claim 3, wherein the clutch is coupled to a rotary shaft of the driving gear to be rotated together with the driving gear.

15. The image forming apparatus as claimed in claim 1, wherein the driving gear is to be rotated in the first direction during printing and is to be rotated in the second direction during replacement of the cartridge.

* * * * *